US008507071B1

(12) United States Patent
Sindall et al.

(10) Patent No.: US 8,507,071 B1
(45) Date of Patent: Aug. 13, 2013

(54) SHEET INSULATOR WITH IMPROVED RESISTANCE TO HEAT TRANSFER BY CONDUCTION, CONVECTION AND RADIATION

(75) Inventors: David Sindall, Toronto (CA); Frank Gojny, Bonita, CA (US); Hyo Yul Kim, Kyungkido (KR)

(73) Assignee: Zeroloft Corporation, Cheyenne, WY (US)

( * ) Notice: Subject to any disclaimer, the term of this patent is extended or adjusted under 35 U.S.C. 154(b) by 578 days.

(21) Appl. No.: 12/703,950

(22) Filed: Feb. 11, 2010

(51) Int. Cl.

| | |
|---|---|
| ***B32B 3/06*** | (2006.01) |
| ***B32B 3/24*** | (2006.01) |
| ***B32B 3/30*** | (2006.01) |
| ***B32B 5/20*** | (2006.01) |
| ***A41D 27/00*** | (2006.01) |
| ***A41D 27/28*** | (2006.01) |
| *A41D 1/00* | (2006.01) |
| *A41D 19/00* | (2006.01) |
| *A43B 1/00* | (2006.01) |
| *A43B 3/00* | (2006.01) |
| *A43B 7/06* | (2006.01) |

(52) U.S. Cl.
USPC ..... 428/137; 428/74; 428/76; 428/119; 428/120; 428/138; 428/161; 428/163; 428/166; 428/167; 428/172; 428/189; 428/192; 2/1; 2/69; 36/1; 156/219; 156/252; 156/253

(58) Field of Classification Search
None
See application file for complete search history.

(56) References Cited

U.S. PATENT DOCUMENTS

| | | | | |
|---|---|---|---|---|
| 3,822,226 | A * | 7/1974 | Taft et al. | 25/127 |
| 5,306,555 | A | 4/1994 | Ramamurthi et al. | |
| 5,420,168 | A | 5/1995 | Mayer et al. | |
| 5,565,142 | A | 10/1996 | Deshpande et al. | |
| 5,789,075 | A | 8/1998 | Frank et al. | |
| 5,962,539 | A | 10/1999 | Perrut et al. | |
| 6,068,882 | A | 5/2000 | Ryu | |
| 6,080,475 | A | 6/2000 | Frank et al. | |
| 6,315,971 | B1 | 11/2001 | Wallace et al. | |
| 6,670,402 | B1 | 12/2003 | Lee et al. | |
| 6,809,171 | B2 * | 10/2004 | Bolte et al. | 528/59 |
| 6,887,563 | B2 | 5/2005 | Frank et al. | |
| 7,101,607 | B2 * | 9/2006 | Mollendorf et al. | 428/158 |
| 7,410,684 | B2 * | 8/2008 | McCormick | 428/190 |
| 7,752,776 | B2 * | 7/2010 | Farnworth | 36/83 |
| 7,754,121 | B2 * | 7/2010 | Ristic-Lehmann et al. | 264/120 |
| 7,943,225 | B2 * | 5/2011 | McCormick | 428/137 |
| 8,069,587 | B2 * | 12/2011 | Purrington et al. | 36/44 |
| 2002/0094426 | A1 | 7/2002 | Stepanian et al. | |
| 2005/0192366 | A1 | 9/2005 | Ou et al. | |
| 2005/0192367 | A1 | 9/2005 | Ou et al. | |
| 2006/0035054 | A1 * | 2/2006 | Stepanian et al. | 428/76 |
| 2006/0254088 | A1 * | 11/2006 | McCormick | 36/44 |
| 2007/0154698 | A1 * | 7/2007 | Stepanian | 428/294.7 |
| 2007/0224390 | A1 * | 9/2007 | McCormick | 428/137 |
| 2009/0029109 | A1 * | 1/2009 | Seth et al. | 428/158 |

* cited by examiner

*Primary Examiner* — David Sample
*Assistant Examiner* — Jeff Vonch
(74) *Attorney, Agent, or Firm* — Patent Law & Venture Group; Gene Scott

(57) ABSTRACT

A sheet insulator is attached to an item of wearing apparel to provide thermal insulation. The sheet insulator has a fiber reinforced aerogel composite encapsulated within a plastic sheeting. The plastic sheeting is secured to the aerogel composite, surface to surface. The plastic sheeting and the aerogel composite have surface upsets such as elongated depressions or burrows positioned and oriented at a flexing position of the wearing apparel so that the sheet insulator is able to flex with the apparel enabling a more natural movement of the apparel.

11 Claims, 2 Drawing Sheets

SHEET INSULATOR WITH IMPROVED RESISTANCE TO HEAT TRANSFER BY CONDUCTION, CONVECTION AND RADIATION

BACKGROUND OF THE INVENTION

1. Field of the Present Disclosure

The invention relates generally to insulated textile-like materials and more particularly to aerogel based textile like materials having excellent insulating properties as well as high flexibility.

2. Description of Related Art Including Information Disclosed Under 37 CFR 1.97 and 1.98

The important insulating properties of aerogel materials are well known. The use of composite structures, that is, multi-layered bonded assemblies are known for the advantages they provide using the benefits of several layers. Such materials have been, and continue to be, applied in the clothing and packaging industries. They provide light weight, effective thermal insulating properties, ease of manufacture and adaptability to a wide range of applications.

The terms "aerogel," "aerogels," "aerogel materials" as used herein, refer to gels containing air as a dispersion medium in a broad sense, and include aerogels, xerogels and cryogels in a more narrow sense. Furthermore, the chemical composition of aerogels, in the meaning of this disclosure can be inorganic, organic, and combinations of inorganic and organic structures. Further, such aerogels can be opacified with compounds such as, but not limited to: $B_4C$, Diatomite, Manganese ferrite, MnO, NiO, SnO, $Ag_2O$, $Bi_2O_3$, TiC, WC, carbon black, titanium oxide, iron titanium oxide, zirconium silicate, zirconium oxide, iron oxide, manganese dioxide, iron titanium oxide, chromium oxide, silicon carbide or mixtures thereof. The aforementioned fiber-reinforced aerogels can be reinforced with polymer-based fibers such as fibers of polyester and/or inorganic fibers such as carbon, quartz, and similar materials where such fibers are in forms such as: batting, mat, felt, microfiber, chopped fiber and any other form, and combinations of these forms.

Examples of inorganic aerogels include, silica, titania, zirconia, alumina, hafnia, yttria and ceria. Organic aerogels can be based on, compounds such as, urethanes, resorcinol formaldehydes, polyimide, polyacrylates, chitosan, polymethyl methacrylate, members of the acrylate family of oligomers, trialkoxysilylterminated polydimethylsiloxane, polyoxyalkylene, polyurethane, polybutadiane, melanime-formaldehyde, phenol-furfural, polyethers, carbons and combinations thereof. Examples of organic-inorganic hybrid aerogels are, silica-PMMA, silica-chitosan, silica-polyether and combinations thereof.

Published US patent applications 2005/0192367 and 2005/0192366 teach exclusively of such hybrid organic-inorganic materials and are hereby incorporated herein by reference in their entirety.

Insulating aerogel materials such as might be used in the present invention have a fiber-reinforced aerogel composite formed by pouring a pre-gel mixture comprising a gel precursor into a fibrous matrix, wherein the mixture then gels. Subsequently the mixture is dried to form the composite, which is typically referred to as an "aerogel blanket." Alternatively, the composite may be prepared by adding fibers, or a fibrous matrix, to the pre-gel mixture comprising gel precursors followed by drying. Drying may be accomplished using a variety of methods known in the art. U.S. Pat. No. 6,670,402 teaches drying via rapid solvent exchange inside wet gels using supercritical $CO_2$ by injecting supercritical, rather than liquid $CO_2$ into an extractor that has been preheated and pre-pressurized to substantially supercritical conditions. U.S. Pat. No. 5,962,539 describes a process for obtaining an aerogel from a polymeric material that is in the form of a sol-gel in an organic solvent, by exchanging the organic solvent for a fluid having a critical temperature below a temperature of polymer decomposition, and supercritically drying the fluid sol-gel. U.S. Pat. No. 6,315,971 discloses a processes for producing gel compositions comprising: drying a wet gel comprising gel solids and a drying agent to remove the drying agent under drying conditions sufficient to minimize shrinkage of the gel during drying. U.S. Pat. No. 5,420,168 describes a process whereby Resorcinol/Formaldehyde aerogels can be manufactured using a simple air drying procedure. Finally, U.S. Pat. No. 5,565,142 describes drying techniques at vacuum to below super-critical pressures using surface modifying agents.

BRIEF SUMMARY OF THE INVENTION

The present invention is a thermal insulating sheet insulator made up of layers of different materials including an aerogel-fiber composite layer sealed on its outside surfaces by applying an adhesive, and then encapsulated within a plastic sheeting. The assembly may be textured or smooth. The assembly may be partially or full covered by a solar reflective film bonded to the underlying plastic sheeting. The assembly may be punctured by through holes which are sealed vias for allowing vapors to pass through the assembly. The assembly may be further covered partially or fully by a tough outer fabric such as a rip-stop fabric bonded to the outside of the assembly to provide wear resistance. The assembly is used as an insulating component in clothing, boots, gloves, hats and other outerwear for maintaining the comfortable personnel temperature while allowing vapors to escape.

An objective of the present invention is to provide a lightweight and flexible sheet product with high thermal insulation properties. A further objective is to provide such a product that is able to reject incident radiant energy. A further objective is to provide such a product wherein water vapor is able to pass readily through it or is conduced away from personnel. A further objective is to provide such a product that is able to incorporate the above advantages while also providing resistance to being damaged through rough handling. Other features and advantages of the present invention will become apparent from the following more detailed description, taken in conjunction with the accompanying drawings, which illustrate, by way of example, the principles of the presently described invention.

BRIEF DESCRIPTION OF THE SEVERAL VIEWS OF THE DRAWINGS

Illustrated in the accompanying drawings are views of the best mode embodiments of the present invention. In such drawings.

DETAILED DESCRIPTION OF THE INVENTION

Aerogel composites reinforced with a fibrous batting, herein referred to as "blankets" or "aerogel blankets," are particularly useful for applications requiring flexibility since they are conformable and provide excellent thermal insulating properties. Aerogel blankets and similar fiber-reinforced aerogel composites are described in published US patent application 2002/0094426A1 and 2007/0154698, and also U.S. Pat. Nos. 6,068,882, 5,789,075, 5,306,555, 6,887,563, and 6,080,475, all hereby incorporated by reference, in their entirety. In an exemplary manner and without an implied limitation, embodiments of the present invention utilize aerogel blankets; though analogous aerogel composites, that is, those disclosed by reference herein may also be similarly utilized.

In the embodiments of the present invention, the aerogel composites are coated with a polymeric material. This may be carried out to reduce free particulate matter on the surface of the aerogel material, provide an abrasion resistant surface, provide a slip layer, or for other reasons. The coating may be applied by spraying, rolling, lamination or other techniques known in the art. Suitable coatings include but are not limited to: acrylic coatings, silicone-containing coatings, phenolic coatings, vinyl acetate coatings, ethylene-vinyl acetate coatings, styrene-acrylate coatings, styrene-butadiene coatings, polyvinyl alcohol coatings, polyvinyl-chloride coatings, acrylamide coatings, copolymers or combinations thereof. The coatings may be further subject to a heat treatment step, cross-linking agents, or both. The coating may be applied either before or after the aerogel is cut into shapes, perforated with holes or otherwise modified.

Figure 1:
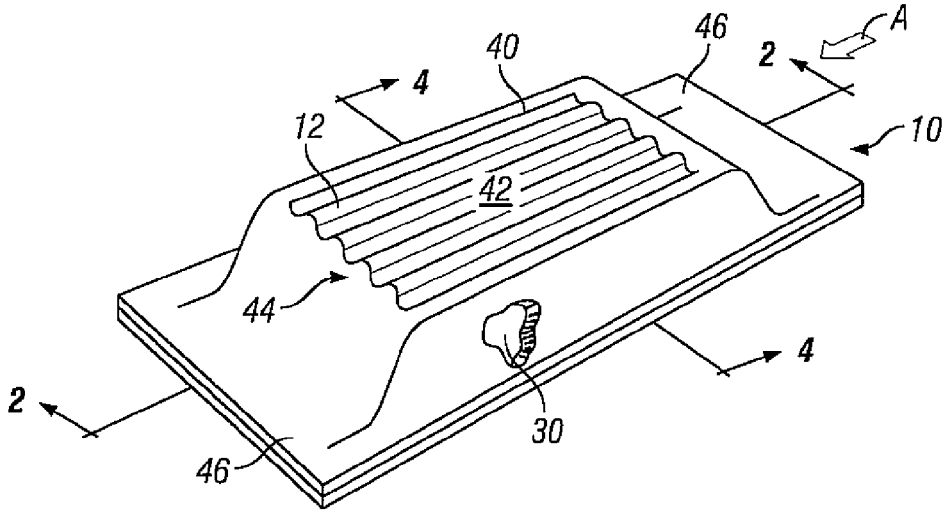
FIG. 1 is a perspective view of a first embodiment of the present invention showing an aerogel plus fiber composite material integrally encased within a plastic sheeting with an embossed surface consisting of rows of linear depressions.
Figure 2:
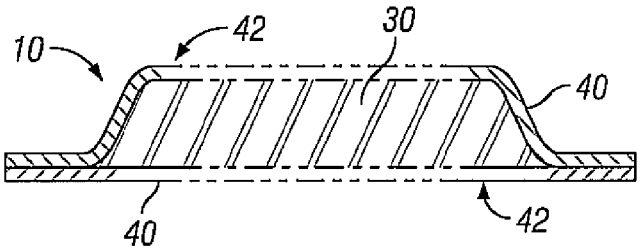
FIG. 2 is a cross-sectional view taken along cutting plane 2-2 in FIG. 1 and showing portions of the plastic sheeting in phantom line indicting that the horizontal dimension of the invention is not restricted to the dimensions shown in FIG. 1.

The present invention is a thermal insulator in the form of a sheet material which is referred to herein by the term "sheet insulator" and is generally referred to by numeral 10 as shown in FIG. 1. As shown and described, other layers may be added to sheet insulator 10 as further embodiments. The sheet insulator 10 may be attached to an item of wearing apparel, a garment 20 such as gloves, boots, jackets, pants, and so on, for thermal insulation thereof as shown in FIGS. 3A, 3B, 5, 6 and 8. The sheet insulator 10 is made up of a fiber reinforced aerogel composite 30 which is fully encapsulated within a primary plastic sheeting 40, the primary plastic sheeting 40 secured to an exterior surface of the aerogel composite 30. The sheet insulator 10 is in the form of a relatively thin sheet having a pair of opposing outer surfaces 42 contiguous with a peripheral edge surface 44. The plastic sheeting 40 is preferably a polythermo-urethane plastic but may be of other similar engineering plastic sheeting. Sheeting 40 is bonded to the aerogel composite 30 using a bonding agent, preferably polyester polyol, toluene diisocyanate, and ethyl acetate, mixed with a hardener composed of: toluene diisocyanate, ethylene glycol and trimethylol propane. This is a bonding agent that causes cross linking and is considered to be an important novelty of the present invention. Because the aerogel composite 30 has excellent thermal insulating properties, the sheet insulator 10 is able to strongly reduce the conduction of heat energy between its outer surfaces 42.

Figure 3A:
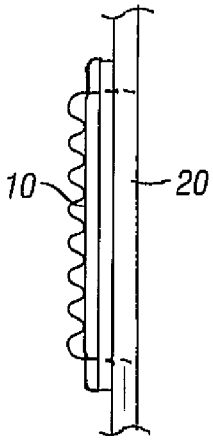
FIG. 3A is an edge view of the invention of FIG. 1 illustrating that the invention may have a lesser thickness than as shown in FIG. 1, and viewed in the direction of arrow A in FIG. 1 thereby illustrating the linear depressions, the invention shown attached to a garment which is represented by numeral 20.
Figure 3B:
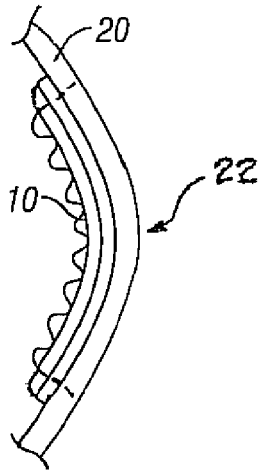
FIG. 3B represents the edge view as shown in FIG. 3A while demonstrating how the embossed surface enhances flexibility of the invention at a flexing point of the garment.
Figure 4:
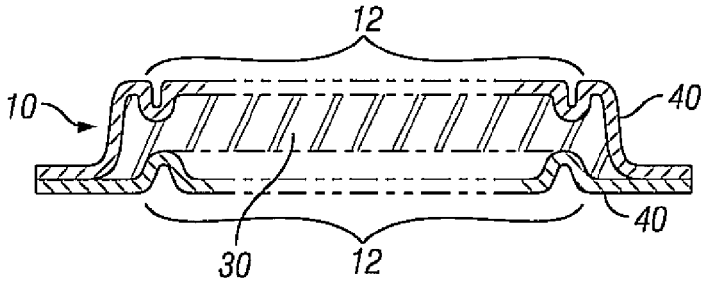
FIG. 4 is a cross-sectional view taken along cutting plane 4-4 in FIG. 1 and showing both a top and bottom surfaces both deformed with the linear depressions.
Figure 5:
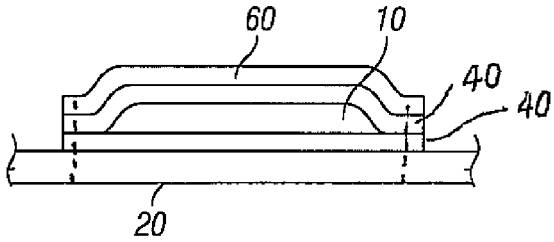
FIGS. 5 and 6 are edge views of a second embodiment of the invention shown attached to a garment as in FIGS. 3A and 3B and also shown covered by a layer of rip-stop fabric, the fabric secured to the plastic sheeting in FIG. 5, and secured to the garment in FIG. 6.
Figure 6:
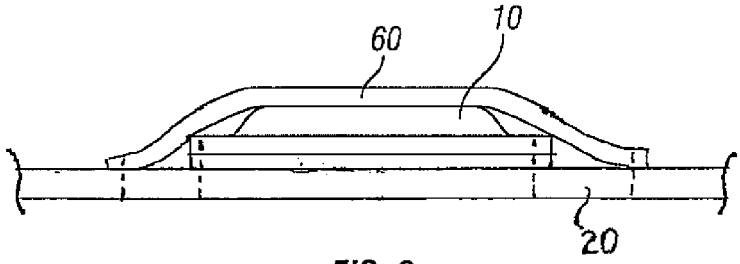

The sheet insulator 10 preferably has an upset 12 as shown in FIG. 4; the term "upset" referring to the configurational character of the primary plastic sheeting surfaces 42 and 44 as well as the exterior surface of the aerogel composite 30 which, as said, lies immediately adjacent to the primary plastic sheeting 40 and follows its contour. The term "upset," as used herein, refers to one or more, that is, singular or plural, characteristics such as depressions, grooves, dimples, and, or other types of impressions, and also to protrusions, pimples, roughness, and other types of relief. To clarify this point it should be realized that a series of depressions, for instance, in a surface may also be described as a series of reliefs as shown in FIG. 4, wherein both the terms, "depressions" and "reliefs" refer to an assumed normative reference surface which may not necessarily need to be defined. Assuming that the sheet insulator 10 may be fixed to the wearing apparel 20 as shown in FIGS. 3A and 3B, and is fixed on the wearing apparel 20, and assuming further, that the wearing apparel 20 may have a portion 22 (FIG. 3B) that in normal use will experience flexing, such as the upper of a boot, the fingers of a glove, or the elbows of a jacket, the upset 12 is preferably positioned to coincide with the flexing portion 22 of the wearing apparel 20 so that the sheet insulator 10 does not present too much resistance to such flexing.

The primary plastic sheeting 40 may be metalized or bonded to a metal foil layer 45 (FIG. 9), so that the sheet insulator 10, as so enhanced, is able to protect against the absorption and transport of radiant heat energy into and through the sheet insulator 10. Metallization of plastic films is well known and described in U.S. Pat. No. 4,973,511 to Farmer et al, and in U.S. Pat. No. 3,681,179 to Theissen, both of which are hereby incorporated herein by reference in their entirety, as exemplary teachings.

Further, an outer layer 60 made of a wear resistant fabric, such as a so-called "rip-stop" or similar fabric, may be bonded or otherwise attached to the sheet insulator 10 (FIG. 5) or to the wearing apparel 20 (FIG. 6) so as to be positioned over the sheet insulator 10, in order to protect it from physical abrasion and wear.

Figure 7:
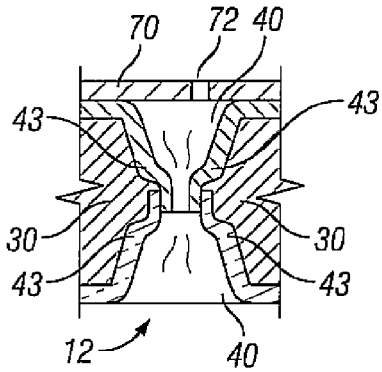
FIG. 7 is a third embodiment of the present invention showing a cross sectional view of a hole formed in the plastic sheeting and the aerogel plus fiber composite, and further showing an additional plastic sheeting covering the hole, the additional plastic sheeting providing a vent hole therein.
Figure 9:
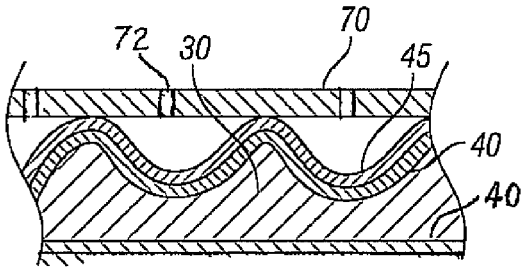
FIG. 9 is a fourth embodiment of the present invention shown as a section view of the invention as in FIG. 4 showing the aerogel composite encased by the plastic sheeting, with one layer of the plastic sheeting covered by a reflective layer, and further showing the additional plastic sheeting referred to in FIGS. 7 and 8 as covering the reflective layer.

To provide for human transpiration in order to prevent the buildup of vapors and heat within garments such as footwear and clothing, which may cause uncomfortable heating, the sheet insulator 10 may have penetrations through it, referred to herein as "first holes" 14 and shown in FIG. 9. The first holes 14 each extend collinearly through both the primary plastic sheeting 40 and the aerogel composite 30. The primary plastic sheeting 40 extends within the first holes 14 from both opposing outer surfaces 42 as shown in FIG. 7, and those portions 43 that do extend into first holes 14 preferably overlap as shown and are integrally fused using ultrasonic welding techniques or other bonding methods. This is important in preventing particle communication between the aerogel composite 30 and the interiors of the first holes 14. In normal use, when sheet insulator 10 is used in a garment, it will experience compressive forces tending to expel loose aerogel particulate. It is highly desirable to prevent such particles from escaping the sheet insulator 10 through first holes 14 because they tend to be extremely small and present a health hazard.

Figure 8:
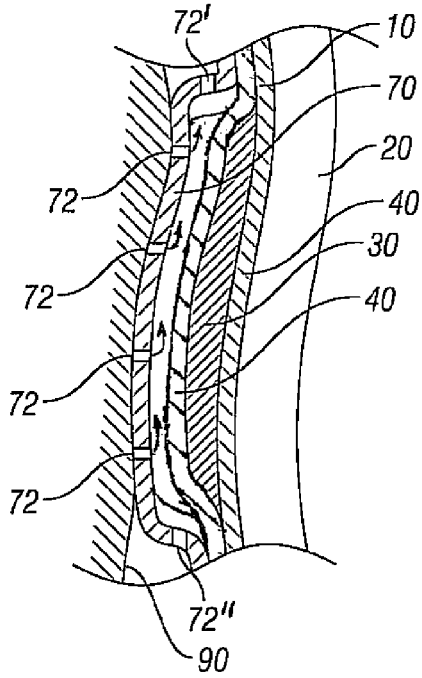
FIG. 8 is a vertical section of the third embodiment shown as taken through and along one of the linear depressions in the plastic sheeting and the aerogel composite as well as the additional plastic sheeting as shown in FIG. 7, and further showing the invention mounted to a garment, shown in edge view on the right side of FIG. 8, and pressed up against the surface of a person wearing the garment shown on the left side of FIG. 8.

Preferably, a secondary plastic sheeting 70 may be bonded to the primary plastic sheeting 40, in such a manner that the secondary plastic sheeting 70 is positioned over the upset 12. For instance if the upset 12 is an elongated depression, the secondary plastic sheeting 70 is bonded to the outer surface 42 of the primary plastic sheeting 40 in a manner and position where it covers over the depression as shown in FIG. 7. Preferably, the secondary plastic sheeting 70 has a plurality of second holes 72 in it, and they preferably are arranged, essentially, in coincidence with upset 12 as shown in FIGS. 7-9. In one embodiment of the present invention, the primary plastic sheeting 40 has a reflective coating on it, such as the metalized layer 45 shown in FIG. 9, and the secondary plastic sheeting 70 is clear. In this case, radiant heat is able to pass through sheeting 70 but is reflected by the reflective coating of sheeting 40. In this respect, radiant energy is rejected away from the aerogel composite, but the depressions 12 operates like a greenhouse so that vapors entering the depressions 12 through second holes 72 are heated and thus are accelerated in rising upward as convection currents. Where the invention is used in very cold conditions, this greenhouse effect is able to produce a heated layer of air on the outside of the sheet insulator 10 which improves the thermal insulating capability of the invention.

FIG. 8 shows, in a vertical section taken directly through a vertical elongated depression 12 in sheet insulator 10 and illustrates the relationship between a person 90 and the present invention when the secondary plastic sheeting 70 is in place covering sheet insulator 10. In this figure secondary plastic sheeting 70 is shown pressed directly against the person 90. In actuality, their may be a garment such as a shirt or undershirt between the person 90 and the present invention. However, in some instances, such as with a glove, the secondary plastic sheeting 70 might be as shown in FIG. 8. In this figure it is shown that second holes 72 receive vapors and liquid perspiration from the person 90 directly into the elongated depressions. In FIG. 8 small arrows show that vapors naturally move as convection currents upwardly and escape through third holes 72' located at a upward terminal end of sheet insulator 10. Condensed Perspiration is able to drip downwardly within the depression 12 to escape through the third holes 72".

Preferably, as shown in FIG. 1, the primary plastic sheeting 40 extends beyond the aerogel composite 30 forming a hem 46. The hem 46 is used to attach the sheet insulator 10 to an item of clothing, boots, gloves or other accessories. Alternate methods of attachment may also be used exclusively or in conjunction with the hem 46. The hem 46 may be joined to wearing apparel or gear by stitching, stapling, bonding or similar techniques.

When the sheet insulator 10 is joined to an item of wearing apparel 20, the combination is configured so that the thermal insulator sheet 10 is placed in a position and an orientation wherein flex points of the item of wearing apparel 20, such as elbow locations in shirts and coats, knee locations in pants, and finger digit's joint locations in the fingers of gloves, and so on, coincide with a selected direction wherein the insulator sheet bends most easily due to the type and orientation of the upset 12. This permits a thick sheet insulator 10 to flex more easily with the garment 20 to which it functions as a liner or an outer cover.

The figures, descriptions thereof and embodiments presented herein are merely presented to better illustrate aspects of the present invention and therefore should not be construed as limitations on the scope or spirit of the invention as a whole.

The invention claimed is:

1. A sheet insulator may be attached to an item of wearing apparel for thermal insulation thereof, the sheet insulator comprising:

a fiber reinforced aerogel composite encapsulated within a primary plastic sheeting, the primary plastic sheeting secured to an exterior surface of the aerogel composite;

the primary plastic sheeting and the aerogel composite mutually bonded by a bonding agent;

a surface of the primary plastic sheeting and the aerogel composite having mutual upsets comprising elongated depressions;

a secondary plastic sheeting bonded to the primary plastic sheeting thereby covering the elongated depressions, the secondary plastic sheeting punctured by a plurality of first holes having a first orientation, the first holes arranged in coincidence with the elongated depressions; and a plurality of second holes in the secondary plastic sheeting, the second holes having a second orientation substantially perpendicular to the first orientation, whereas when moisture enters into the depressions through the first holes the depressions direct the moisture to one or more of the second holes wherein said moisture is able to escape through the one or more second holes.

2. The sheet insulator of claim 1 further comprising one of a metalized and metal foil layer covering the primary plastic sheeting.

3. The sheet insulator of claim 1 further comprising an outer layer of a wear resistant fabric.

4. The sheet insulator of claim 1 wherein a plurality of third holes extend therethrough, the primary plastic sheeting formed within the third holes thereby preventing aerogel particles from entering the third holes.

5. The sheet insulator of claim 1 wherein the primary plastic sheeting extends beyond the aerogel composite forming a hem.

6. A combination of a thermal insulator sheet and an item of wearing apparel, the combination comprising:

the thermal insulator sheet including a fiber reinforced aerogel composite encapsulated within a primary plastic sheeting, the primary plastic sheeting secured to an exterior surface of the aerogel composite;

the primary plastic sheeting and the aerogel composite mutually bonded by a bonding agent;

a surface of the primary plastic sheeting and the aerogel composite having mutual upsets comprising elongated depressions positioned and conformed so that the thermal insulator sheet bends most easily in a selected direction;

a secondary plastic sheeting bonded to the primary plastic sheeting thereby covering the elongated depressions, the secondary plastic sheeting punctured by a plurality of first holes having a first orientation, the first holes arranged in coincidence with the elongated depressions;

a plurality of second holes in the secondary plastic sheeting, the second holes having a second orientation substantially perpendicular to the first orientation, whereas when moisture enters into the depressions through the first holes the depressions direct the moisture to one or more of the second holes wherein said moisture is able to escape through the one or more second holes; and the thermal insulator sheet fixed to the item of wearing apparel in a position and an orientation wherein flexing of the item of wearing apparel coincides with the selected direction wherein the insulator sheet bends most easily.

7. The combination of claim 6 further comprising one of a metalized and metal foil layer covering the primary plastic sheeting.

8. The combination of claim 6 further comprising an outer layer of a wear resistant fabric.

9. The combination of claim 6 wherein a plurality of third holes extend therethrough, the primary plastic sheeting formed within the third holes thereby preventing aerogel particles from entering the third holes.

10. The combination of claim 6 wherein the primary plastic sheeting extends beyond the aerogel composite forming a peripheral hem.

11. A method of directing moisture in a sheet insulator, the method comprising:

encapsulating a fiber reinforced aerogel composite within a primary plastic sheeting;

securing the primary plastic sheeting to an exterior surface of the aerogel composite with a bonding agent;

mutually upsetting a surface of the primary plastic sheeting and the aerogel composite with elongated depressions;

bonding a secondary plastic sheeting to the primary plastic sheeting thereby covering the elongated depressions;

puncturing the secondary plastic sheeting with a plurality of first holes having a first orientation, and arranging the first holes in coincidence with the elongated depressions;

puncturing the secondary plastic sheeting with a plurality of second holes having a second orientation substantially perpendicular to the first orientation; and directing moisture entering into the depressions through the first holes to at least one of the second holes wherein said moisture escapes through the at least one of the second holes.

* * * * *